US005566696A

United States Patent [19]

Dries et al.

[11] Patent Number: 5,566,696

[45] Date of Patent: Oct. 22, 1996

[54] DISHWASHER WITH BALANCING VANES ON PUMP IMPELLER

[75] Inventors: John E. Dries; James M. Edwards, both of Kinston, N.C.

[73] Assignee: White Consolidated Industries, Inc., Cleveland, Ohio

[21] Appl. No.: 450,918

[22] Filed: May 26, 1995

[51] Int. Cl.[6] ..... B08B 3/02

[52] U.S. Cl. ..... 134/104.1; 134/111; 134/188; 134/191; 277/53; 277/57

[58] Field of Search ..... 134/104.1, 111, 134/155, 188, 191; 277/53, 54, 55, 56, 57

[56] References Cited

U.S. PATENT DOCUMENTS

| | | | |
|---|---|---|---|
| 721,207 | 2/1903 | Lockwood . | |
| 768,911 | 8/1904 | Sohoene . | |
| 1,342,592 | 6/1920 | Orr . | |
| 1,879,803 | 1/1930 | Johnson . | |
| 2,349,731 | 3/1942 | Hornschuch . | |
| 2,448,717 | 9/1948 | Jeffcock | 277/53 X |
| 2,681,658 | 6/1954 | Meeker et al. | 134/111 |
| 2,787,960 | 4/1957 | Wightman . | |
| 2,827,261 | 3/1958 | Parker et al. . | |
| 3,108,606 | 10/1963 | Grunvogel | 134/111 |
| 3,491,780 | 1/1970 | Kaldenberg | 134/111 |
| 4,038,103 | 7/1977 | Grunewald . | |
| 4,168,715 | 9/1979 | Spiegal et al. . | |
| 4,228,962 | 10/1980 | Dingler et al. . | |
| 4,319,599 | 3/1982 | Dingler et al. . | |
| 4,347,861 | 9/1982 | Clearman et al. . | |
| 4,406,583 | 9/1983 | Becker et al. . | |
| 4,664,592 | 5/1987 | Grzina . | |
| 4,741,353 | 5/1988 | Milocco . | |
| 4,754,772 | 7/1988 | Nord et al. . | |
| 4,799,855 | 1/1989 | Milocco et al. . | |
| 4,822,241 | 4/1989 | Jarvis et al. . | |
| 4,833,900 | 5/1989 | Babuin et al. | 134/111 |
| 4,848,382 | 7/1989 | Bertsch et al. . | |
| 4,969,479 | 11/1990 | Lagerstrand . | |
| 4,998,548 | 3/1991 | Lagerstrand . | |
| 5,076,757 | 12/1991 | Dorsch . | |
| 5,106,262 | 4/1992 | Oklejas et al. . | |
| 5,131,420 | 7/1992 | Favret et al. . | |
| 5,131,432 | 7/1992 | Santarossa et al. . | |
| 5,143,513 | 9/1992 | Ellingson et al. . | |
| 5,209,635 | 5/1993 | Stewart et al. . | |
| 5,234,318 | 8/1993 | Brandon . | |
| 5,345,957 | 9/1994 | Cooper et al. | 134/111 |

FOREIGN PATENT DOCUMENTS

| | | | |
|---|---|---|---|
| 1933543 | 1/1971 | Germany | 134/111 |

*Primary Examiner*—Frankie L. Stinson

*Attorney, Agent, or Firm*—Pearne, Gordon, McCoy & Granger

[57] ABSTRACT

A dishwasher sump is divided into a collection chamber and a pump chamber by a filter. Food particles collect in the collection chamber while filtered wash liquid collects in the pump chamber. A pump has an impeller located in the pump chamber. The filtered wash liquid is recycled and sprayed on objects in the dishwasher by the pump. The impeller is driven by a shaft extending through the collection chamber and a wall separating the pump chamber from the collection chamber. Food particles in the collection chamber are minced by a rotating blade on the pump shaft. Balancing vanes on a rear face of the impeller prevent food particles and dirty water from flowing into the filtered liquid from the collection chamber. At the end of a wash cycle, the minced food particles are pumped to a drain with the wash liquid.

17 Claims, 4 Drawing Sheets

DISHWASHER WITH BALANCING VANES ON PUMP IMPELLER

BACKGROUND OF THE INVENTION

1. Field of the Invention

This invention relates generally to the field of dishwashers and specifically to a dishwasher having a pump impeller provided with balancing vanes.

2. Description of the Related Art

Dishwashers, particularly those used in domestic applications, have a wash chamber conventionally provided with a sump at a lower part of the wash chamber. Wash liquid sprayed on dishes and other objects in the wash chamber flows downwardly into the sump where the liquid collects. The liquid can flow through a filter so that food particles are retained in a collection chamber of the sump. Filtered wash liquid in the sump is recycled to be sprayed on the dishes or directed toward a drain. The food particles are eventually pumped to the drain with the wash liquid. Such dishwashers are shown, for example, in U.S. Pat. Nos. 4,038,103 to Grunewald, 4,319,599 to Dingler, 4,347,861 to Clearman, 4,754,772 to Nord, 4,969,479 and 4,998,548 both to Lagerstrand. Large food particles may remain in the collection chamber causing unwanted clogging or odors.

In some installations, separate pumps (a recycling pump and a drain pump) are used to direct the liquid to the appropriate locations. In other installations, a single pump may be used in conjunction with a valve system to direct the liquid to either the drain or the wash chamber. An example of this is shown in U.S. Pat. No. 4,848,382 to Bertsch, incorporated herein by reference. Various applications have used impellers having vanes on both sides, as shown in U.S. Pat. Nos. 1,342,592 to Orr, 4,664,592 to Grzina, and 5,076,757 to Dorsch. Separate impellers on one shaft are shown in U.S. Pat. Nos. 4,799,855 to Milocco and 5,131,420 to Favret.

It would be preferable to use a single uni-directional motor to reduce cost and complexity, and improve efficiency. Advantageously, a shaft of the motor can extend through a wall separating the collection chamber from the pump chamber. Food particles and material from the dishes should not be recycled and should not interfere with the flow of liquid to the dishes or to the drain. In addition, it is desirable to isolate the pump from the food and other material to prevent clogging or damage to the pump.

SUMMARY OF THE INVENTION

The present invention provides a washer, such a dishwasher, having a wash chamber in which objects are treated with a liquid. First and second sump chambers are in communication with the wash chamber. A filter is disposed between the first sump chamber and the second sump chamber. A shaft extending through the first chamber is connected to a motor for driving the shaft. A pump has an inlet in communication with the second chamber and an impeller connected to the shaft. The impeller has first vanes on a first face of the impeller adapted for moving liquid from the second sump chamber to the wash chamber, and second vanes on an opposite face of the impeller adapted to resist flow from the first sump chamber into the pump.

A second filter is disposed between the wash chamber and the second sump chamber. A wall is disposed between the impeller and the first wash chamber and extends through said wall. A labyrinth seal is disposed on the shaft, at the wall, and in the first chamber. A mincing blade is located in the first chamber and disposed on the shaft. A spray arm in communication with the pump is adapted to spray the liquid in the wash chamber. The impeller comprises a disk defining the opposed faces, and the second vanes extend radially on a generally straight path. The first vanes extend radially on a curved path.

DESCRIPTION OF THE PREFERRED EMBODIMENTS

Figure 1:
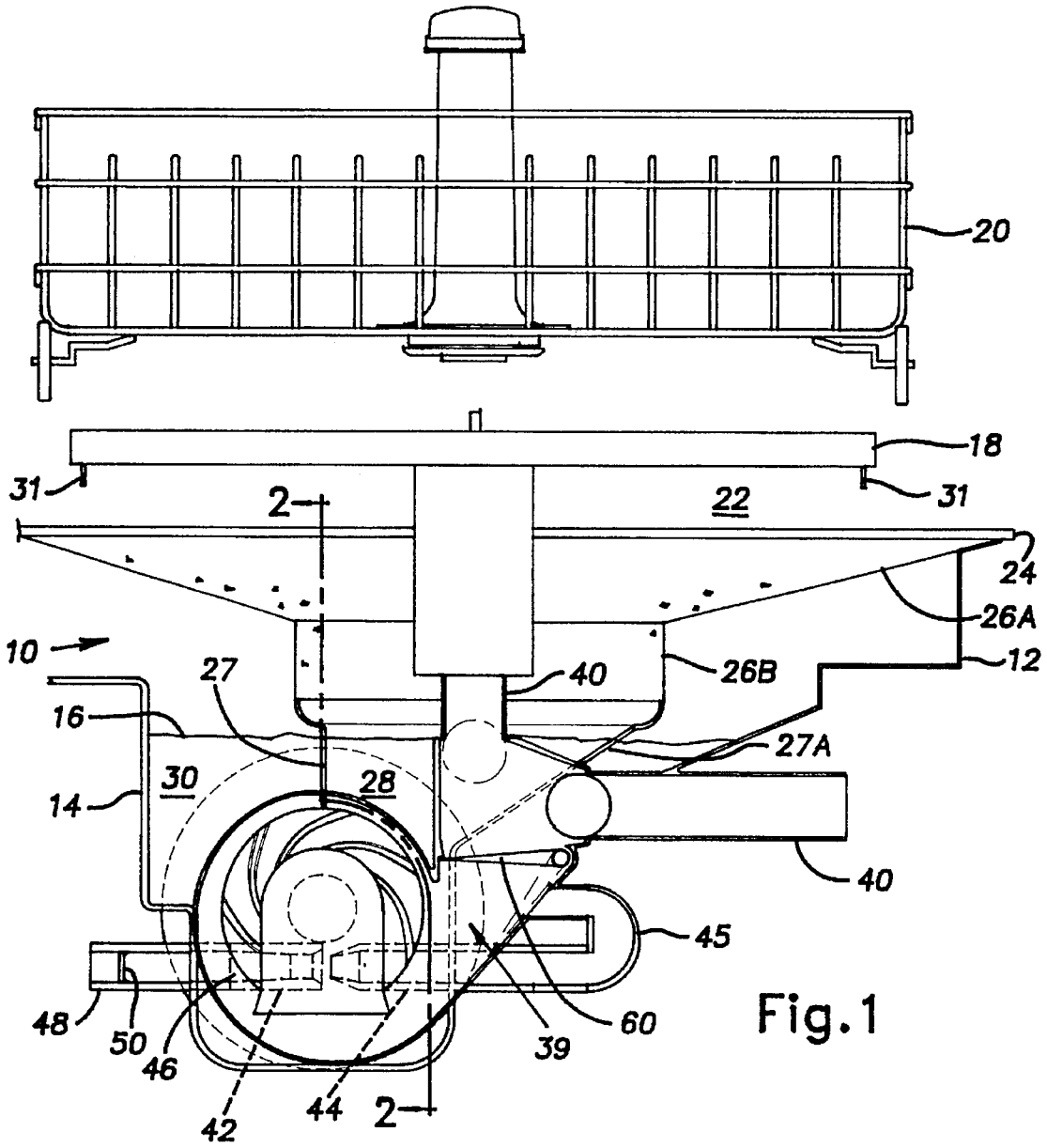
FIG. 1 is a partial elevational view of a dishwasher showing a sump, pump, and drain according to the invention.

Referring to FIG. 1, a dishwasher 10 includes a molded plastic tub 12 having a sump 14 molded therein or fastened thereto. The sump 14 collects and holds wash liquid 16 that is sprayed from one or more spray arms 18 onto objects held in a rack 20 inside a wash chamber 22. The wash liquid 16 returns from the wash chamber 22 by force of gravity to the sump 14. A coarse filter 24, such as a grate, is disposed between the wash chamber 22 and the sump 14 to prevent flatware an other large objects from entering the sump 14. A fine filter 26 having a sloped, generally horizontal filter component 26A and an annular vertical filter component 26B is disposed in the sump 14 below the coarse filter 24. The fine filter 26 is preferably a molded mesh screen having 4 mm (0.015 in.) openings. An inner wall 27 of the sump 14 defines an extension of the fine filter 26 and separates the sump 14 into a first chamber, referred to as a collection chamber 28 or quiet chamber, and a second chamber, referred to as a pump chamber 30. The horizontal filter component 26A and a generally horizontal component 27A of the inner wall are sloped downwardly toward the collection chamber 28 to "funnel" food particles from the wash chamber 22 into the collection chamber. Wash liquid flows downwardly through the horizontal component 26A into the pump chamber 30. The fine filter 26 and inner wall 27 isolate the pump chamber 30 from the wash chamber 22 so that food particles and other material in the wash liquid are filtered out before the wash liquid enters the pump chamber 30. In one embodiment of the invention, the horizontal filter component 26A is located directly below the wash arm 18. The wash arm is then provided with a spray nozzle 31 adapted to direct wash liquid at the filter 26A and propel food particles toward the collection chamber 28. Other filter and wall arrangements that filter wash liquid and collect food particles in a chamber are also suitable for the present invention. Food particles are retained in the collection chamber 28 and macerated therein. When the liquid level is high enough, some of the wash liquid in the collection chamber 28 flows through the vertical component 26B into the pump chamber 30. In one embodiment of the invention, an additional component of the fine filter is provided in the inner wall 27 at a lower part of the collection chamber to permit liquid flow from the bottom of the collection chamber into the pump chamber.

Figure 2:
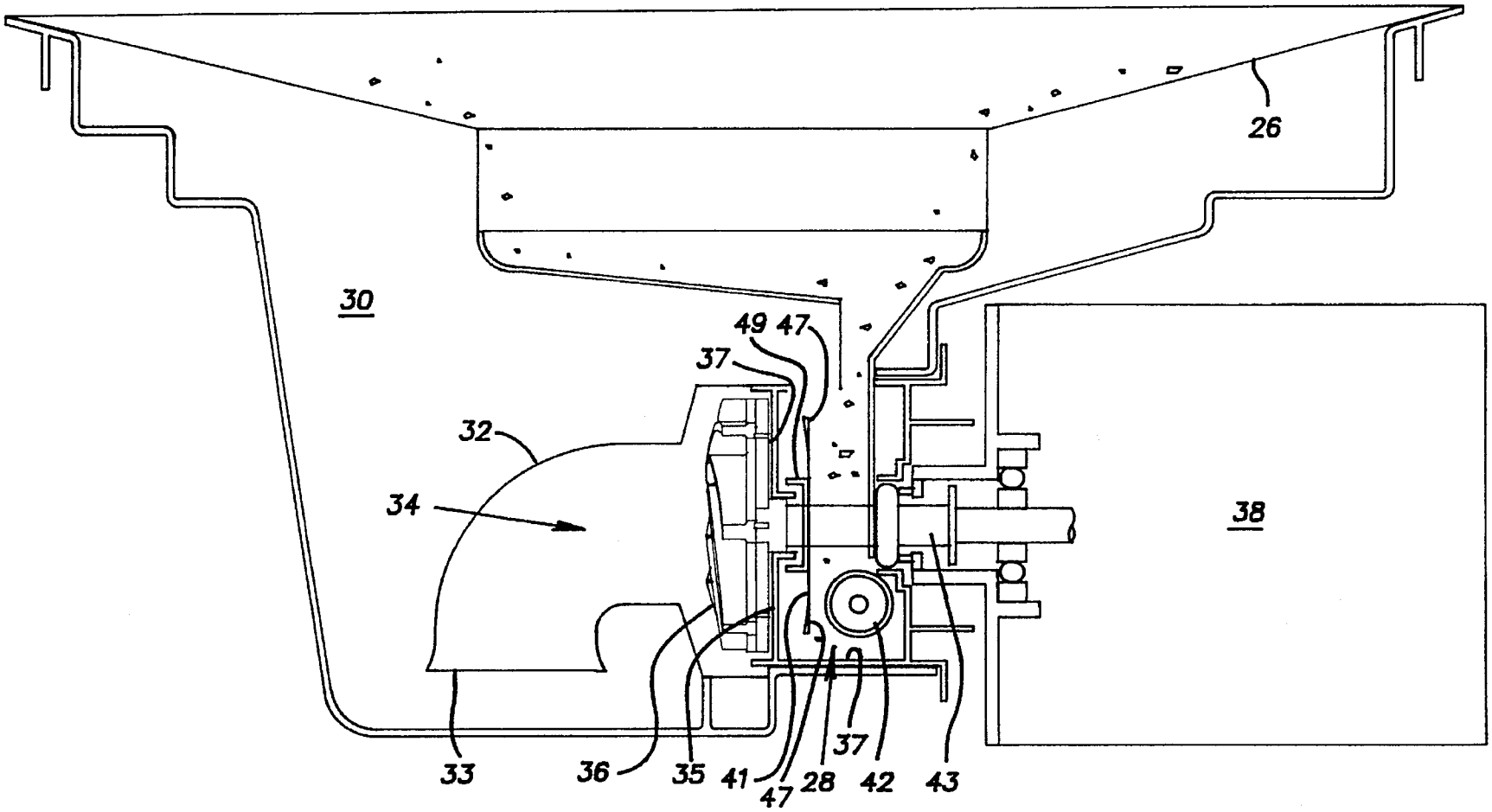
FIG. 2 is an elevational view in a section taken from line 2—2 of FIG. 1.

Referring to FIG. 2, the pump chamber 30 communicates with an inlet 32 of a pump 34 having an impeller 36 driven by a motor 38. A mouth 33 of the inlet 32 is substantially horizontal and disposed at or below the level of a bottom wall 37 of the collection chamber 28 to ensure complete discharge of liquid in the collection chamber. The impeller 36 and a mincing blade 41 are disposed on a shaft 43 driven by the motor 38. The shaft 43 extends through a wall 35 that separates the pump 34 and impeller 36 from the collection chamber 28. The blade 41 is made from a hard, corrosion resistant material, such as stainless steel or aluminum. The blade 41 has sharp edges 47 that chop the food particles in the collection chamber 28. The edges 47 can be angled slightly from the plane in which the blade 41 rotates for circulating liquid and food particles within the collection chamber 28 for more efficient mincing. The circulation created by the blade 41 and the rotation of the shaft 43 might cause some of the liquid to migrate or flow toward the pump 34 around the shaft. A seal, such as a labyrinth seal 49, and/or balancing vanes 37 on a rear face of the impeller 36 are adapted for preventing such migration or flow.

Referring to FIG. 1, an outlet 39 of the pump 34 is in communication with one or more conduits 40. The pump 34 moves wash liquid 16 from the pump chamber 30 through the conduit 40 to the spray arm 18. A venturi 42 has a inlet 44 in communication with the pump outlet 39 through a U-pipe 45. An outlet 46 of the venturi 42 communicates with a drain pipe 48 through a check valve 50. A diverter valve 60 operated by a solenoid (not shown) selectively connects the pump outlet 39 to the wash arm conduits 40 or the venturi 42.

Figure 3:
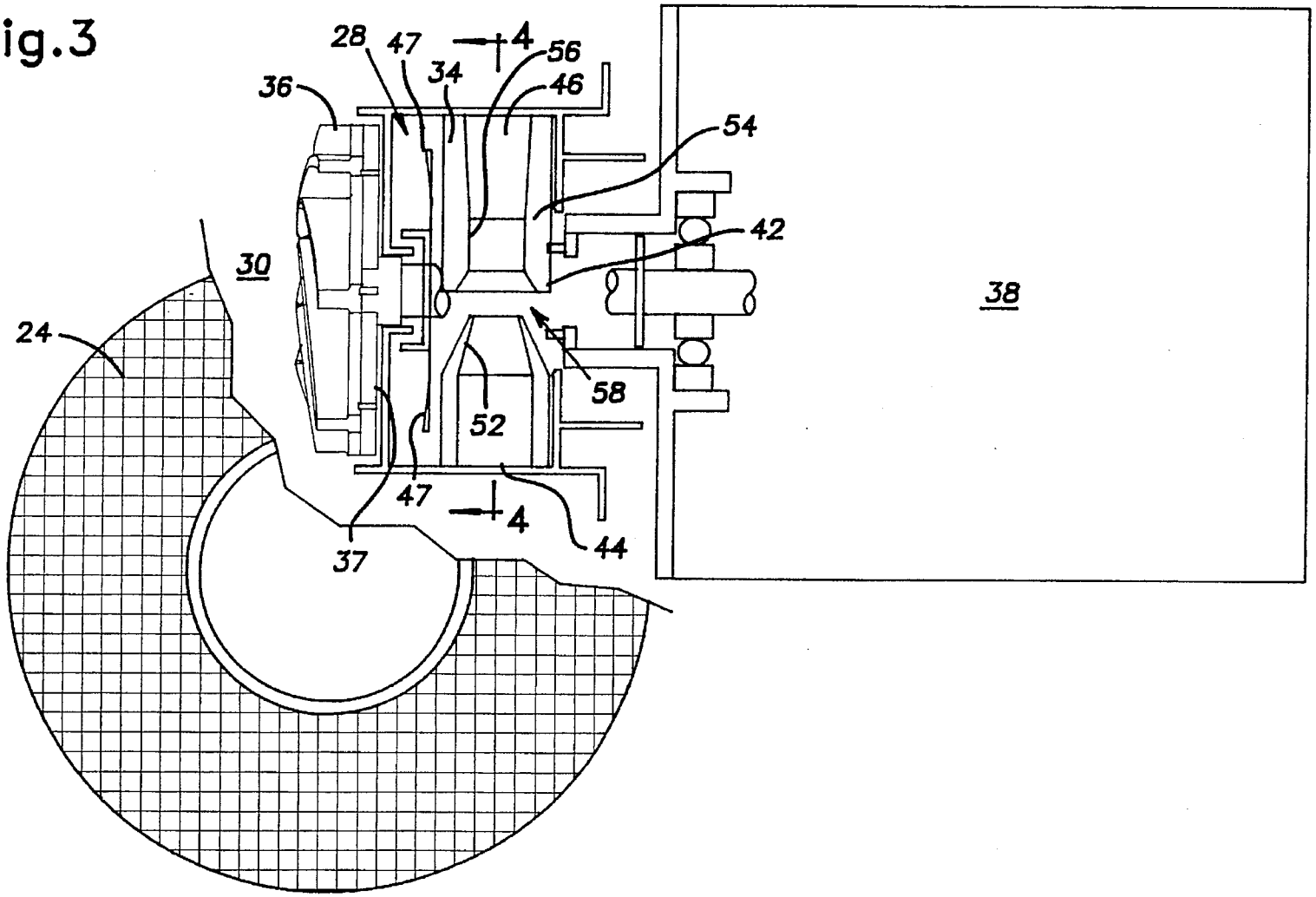
FIG. 3 shows a top view of the sump with part of a filter cut away.

Referring to FIG. 3, the venturi 42 includes a nozzle 52 and a diffuser 54 defining a throat 56. A suction gap 58 between the nozzle 52 and the diffuser 54 communicates with the collection chamber 28. The venturi 42 is configured as an educator type jet pump. A relatively high pressure stream of wash liquid is directed through the nozzle 52, which is designed to develop a high velocity of liquid flow. The high velocity liquid creates a low pressure area in the diffuser 54 causing liquid and food particles from the collection chamber to flow into the diffuser 54 through the suction gap 58. In the diffuser, low velocity suction liquid from the collection chamber 28 mixes with the high velocity liquid. At the venturi outlet 46, the velocity of the mixed liquid reduces and the pressure increases.

Figure 5:
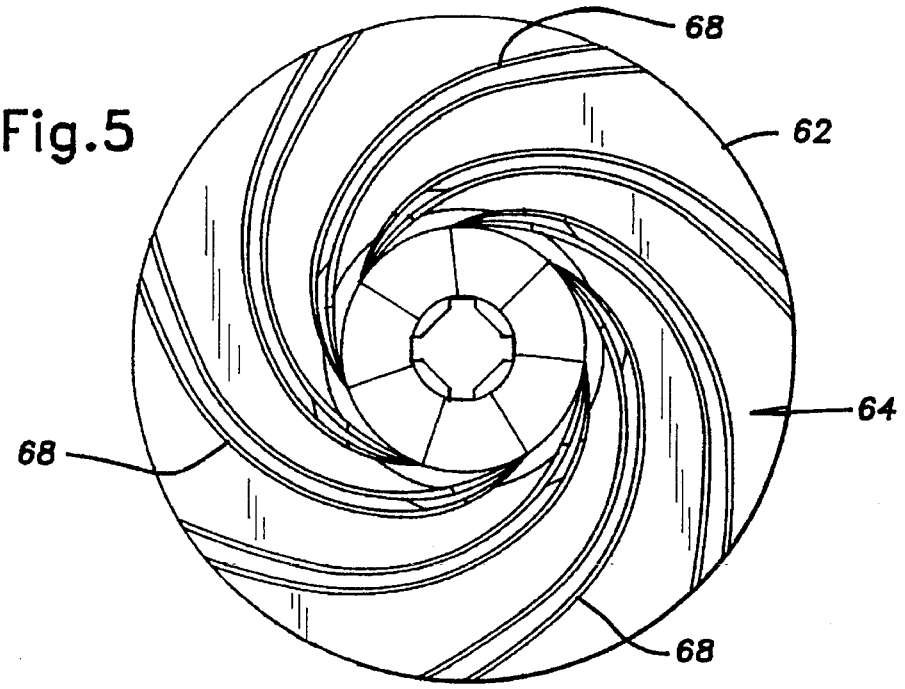
FIG. 5 shows a front view of the impeller of FIG. 4.
Figure 4:
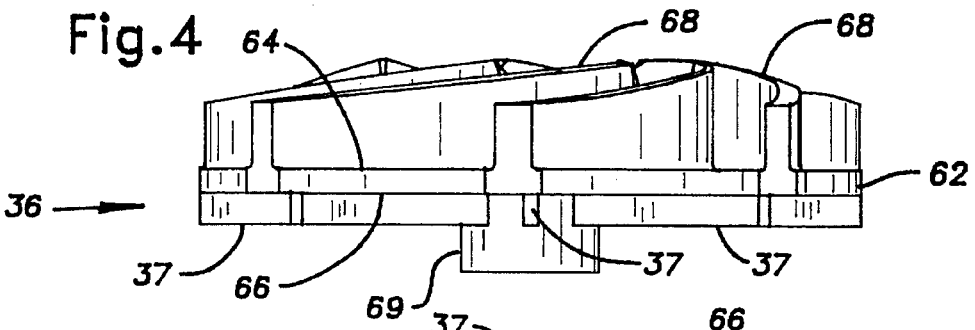
FIG. 4 shows a side view of a pump impeller according to the invention.

Referring to FIG. 4, the impeller 36 is preferably made of a rigid, durable material, such as plastic or stainless steel. A disk shaped base 62 defines a front face 64 and an opposed rear face 66 of the base. Main vanes 68 project from the front face 64. As shown in FIG. 5, the main vanes 68 extend radially along a curved path to define a spiral or pinwheel configuration that is conventional in centrifugal pumps.

Figure 6:
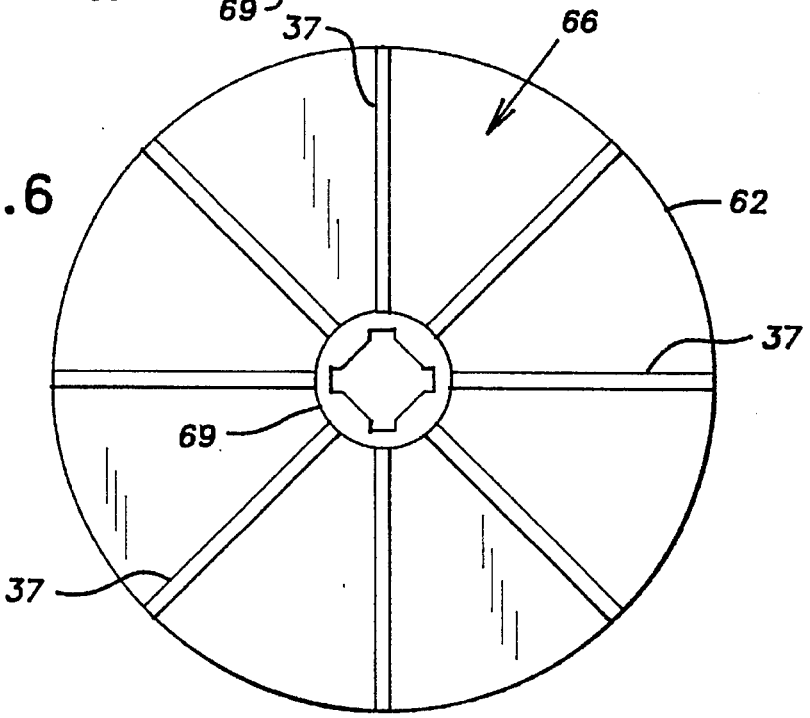
FIG. 6 shows a rear view of the impeller of FIG. 4.

As shown in FIGS. 4 and 6, a mounting hub 69 is provided for securing the impeller 36 to the shaft 43 (FIG. 2). The balancing vanes 37 or auxiliary vanes project from the rear face 66 of the disk 62. The balancing vanes 37 are generally rectangular ribs extending radially from the hub 69 and projecting normally from the rear face 66. As shown, the balancing vanes 37 are straight and radial, but could be slightly curved or angled to increase or decrease inward radial flow along the rear face 66 toward the hub 69.

During a wash operation, the diverter valve 60 is in a recirculate position (shown in phantom in FIG. 1). Wash liquid 16 from the pump chamber 30 is pumped through the conduit 40 and out of the spray arm 18 onto objects being washed. The wash liquid 16 flows down through the coarse filter 24 into the sump 14. Objects and large food particles are filtered by the coarse filter 24. The large food particles will eventually be eroded and dissolved until they pass through the coarse filter. The wash liquid continues flowing downwardly through the fine filter 26, which filters most of the food particles. The filtered wash liquid flows into the pump chamber 30, from where it is recirculated through the wash arm 18 by the pump 34. Food particles tend to move down the sloped horizontal component 26A of the fine filter 26 and the horizontal component 27A of the inner wall 27 toward the collection chamber 28. Wash liquid 16, containing food particles, that does not flow through the fine filter 26 flows into the collection chamber, where the food particles are collected. Wash liquid from the collection chamber 28 is filtered and flows into the pump chamber 30 or remain in the collection chamber 28. Food particles in the collection chamber 28 are macerated by the liquid and, when the motor 38 is operating, chopped or minced by the blade 41. The minced particles are later evacuated through the venturi 42, as described below, or by a drain pump, for example.

When the pump 34 is operating, the main vanes 68 of the rotating impeller 37 create a liquid flow through the pump causing a reduced pressure inside the pump. In addition, the mincing blade can tend to create a flow from the collection chamber 28 toward the pump 34. The balancing vanes 37 create a back pressure toward the wall 35 and around the shaft 43 to prevent liquid and food particles in the collection chamber 28 from flowing around the shaft into the pump 34. The labyrinth seal 49 further inhibits flow from the collection chamber. When the pump 34 is not operating, the pressure is substantially balanced in the collection chamber 28 and pump so that the labyrinth provides an adequate seal.

When the wash operation is completed, the solenoid moves the diverter valve 60 to a drain position (shown in solid lines in FIG. 1). The pump 34 forces wash liquid from the pump chamber 30 through the U-pipe 45 to the venturi 42. The flow of wash liquid through the venturi 42 entrains wash liquid in the collection chamber 28 through the suction gap 58. The entrained wash liquid carries food particles from the collection chamber 28 through the diffuser 54 to the drain pipe 48. Draining continues until the liquid level in the pump chamber 30 is below the pump mouth 33 and, preferably, the collection chamber 28 is substantially empty. Substantially all of the food particles in the collection chamber are thereby discharged from the dishwasher 10. The diverter valve 60 is returned to the recirculating position for a subsequent wash cycle.

The present disclosure describes several embodiments of the invention, however, the invention is not limited to these embodiments. Other variations are contemplated to be within the spirit add scope of the invention and appended claims.

What is claimed is:

1. A washer comprising:

a wash chamber in which objects are treated with a liquid;

first and second sump chambers in communication with the wash chamber;

a filter disposed between the first sump chamber and the second sump chamber;

a shaft extending through the first chamber;

a wall disposed between the first sump chamber and the second sump chamber, the shaft extending through the wall;

a motor connected to drive the shaft;

a pump having an inlet in communication with the second chamber; and an impeller of the pump disposed in the second sump chamber and connected to the shaft, said impeller comprising first vanes on a first face of the impeller adapted for moving liquid from the second sump chamber to the wash chamber, and second vanes on an opposite face of the impeller adapted to resist flow from the first sump chamber into the second sump chamber.

2. A washer according to claim 1, further comprising a second filter disposed between the wash chamber and the second sump chamber.

3. A washer according to claim 1, further comprising a labyrinth seal disposed on the shaft, at the wall, and in the first sump chamber.

4. A washer according to claim 1, further comprising a mincing blade in the first chamber.

5. A washer according to claim 4, wherein the blade is disposed on the shaft.

6. A washer according to claim 1, further comprising a spray arm in communication with the pump and adapted to spray the liquid in the wash chamber.

7. A washer according to claim 1, wherein the impeller comprises a disk defining the opposed faces, and the second vanes extend radially on a generally straight path.

8. A washer according to claim 7, wherein the first vanes extend radially on a curved path.

9. A washer according to claim 1, wherein the first face of the impeller defines an inlet side of the impeller.

10. A washer according to claim 1, wherein said second vanes of said impeller increase liquid pressure in said second sump chamber at said wall.

11. A washer according to claim 1, wherein said second vanes create a back pressure toward said wall and around said shaft.

12. A washer comprising:

a wash chamber in which objects are treated with a liquid;

first and second sump chambers in communication with the wash chamber;

a filter disposed between the first sump chamber and the second sump chamber;

a shaft extending through the first chamber;

a motor connected to drive the shaft;

a mincing blade disposed in the first chamber and driven by the motor;

a pump having an inlet in communication with the second chamber;

a wall disposed between the pump and the first chamber, the shaft extending through the wall; and an impeller of the pump connected to the shaft, said impeller comprising first vanes on a first face of the impeller adapted for moving liquid from the second sump chamber to the wash chamber, and second vanes on an opposite face of the impeller adapted to resist flow from the first sump chamber into the pump.

13. A dishwasher comprising:

a tub defining a wash chamber in which objects are washed with a liquid;

a movable rack adapted for holding the objects;

a sump in a lower part of the tub defining first and second sump chambers in communication with the wash chamber;

a filter disposed between the first sump chamber and the second sump chamber;

a shaft extending through the first chamber;

a wall disposed between the first sump chamber and the second sump chamber, the shaft extending through the wall;

a motor connected to drive the shaft;

a pump having an inlet in communication with the second chamber;

a sprayer adapted for spraying liquid on the objects; and an impeller of the pump disposed in the second sump chamber and connected to the shaft, said impeller comprising first vanes on a first face of the impeller adapted for moving liquid from the second sump chamber to the wash chamber through the sprayer, and second vanes on an opposite face of the impeller adapted to resist flow from the first sump chamber into the second sump chamber.

14. A washer according to claim 13, wherein said opposite face of said impeller is facing said wall.

15. A dishwasher according to claim 13, wherein said second vanes of said impeller increase liquid pressure in said second sump chamber at said wall.

16. A dishwasher according to claim 13, wherein said opposite face of said impeller is facing said wall.

17. A dishwasher according to claim 13, wherein said second vanes create a back pressure toward said wall and around said shaft.

* * * * *